US009024861B2

(12) United States Patent
Takahashi et al.

(10) Patent No.: US 9,024,861 B2
(45) Date of Patent: May 5, 2015

(54) DISPLAY DEVICE, AND DISPLAY METHOD

(75) Inventors: Kohzoh Takahashi, Osaki (JP); Toshihiro Yanagi, Osaka (JP); Taketoshi Nakano, Osaka (JP); Asahi Yamato, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 77 days.

(21) Appl. No.: 14/007,003

(22) PCT Filed: Apr. 9, 2012

(86) PCT No.: PCT/JP2012/059705

§ 371 (c)(1),
(2), (4) Date: Sep. 24, 2013

(87) PCT Pub. No.: WO2012/141142

PCT Pub. Date: Oct. 18, 2012

(65) Prior Publication Data

US 2014/0015869 A1 Jan. 16, 2014

(30) Foreign Application Priority Data

Apr. 13, 2011 (JP) ..... 2011-089463

(51) Int. Cl.
*G09G 3/36* (2006.01)
*G09G 3/34* (2006.01)

(52) U.S. Cl.
CPC ..... *G09G 3/3406* (2013.01); *G09G 2320/0626* (2013.01)

(58) Field of Classification Search
None
See application file for complete search history.

(56) References Cited

U.S. PATENT DOCUMENTS

2005/0104839 A1* 5/2005 Baik ..... 345/102
2009/0251399 A1* 10/2009 Kim ..... 345/89

FOREIGN PATENT DOCUMENTS

JP 2000-347762 A 12/2000
JP 2005-37685 A 2/2005

OTHER PUBLICATIONS

Official Communication issued in International Patent Application No. PCT/JP2012/059705, mailed on May 1, 2012.

* cited by examiner

*Primary Examiner* — Joseph Haley
(74) *Attorney, Agent, or Firm* — Keating & Bennett, LLP

(57) ABSTRACT

A display device of the present invention includes (i) a BL control parameter calculating section (224) for calculating a BL control parameter on the basis of an input image, (ii) a BL luminance control signal generating block (230) for generating a BL luminance control signal on the basis of the BL control parameter and (iii) an output section (225) for supplying, to the BL luminance control signal generating block (230), a BL control parameter that has been calculated by the BL control parameter calculating section (224) immediately before a suspension time period during which a display controlling section is being suspended.

8 Claims, 5 Drawing Sheets

DISPLAY DEVICE, AND DISPLAY METHOD

TECHNICAL FIELD

The present invention relates to a display device, such as a liquid crystal display device, which includes a light source such as a backlight.

BACKGROUND ART

In order to reduce electric power consumption of a liquid crystal display device, there has proposed a technique of attaining low power consumption of the liquid crystal display device by setting a driving frequency of a liquid crystal display driving circuit of the liquid crystal display device lower than a normal driving frequency of the liquid crystal display driving circuit (see, for example, Patent Literature 1).

The technique, however, has a problem that the electric power consumption cannot be sufficiently reduced. This is because even during the low power consumption, (i) a control circuit, which outputs control signals for controlling the driving frequency of the liquid crystal display driving circuit, and (ii) the liquid crystal display driving circuit are being driven.

In order to address the problem, there has proposed a technique (hereinafter, referred to as a suspension driving) of reducing electric power consumption of a liquid crystal display device by causing a control circuit and a liquid crystal display driving circuit to be suspended on a predetermined cycle (see, for example, Patent Literature 2).

There has also known a technique (hereinafter, referred to as an active backlight driving such as Light Adaptive Backlight Control (LABC)) of reducing electric power consumption of a liquid crystal display device by controlling (i) an image process and (ii) a luminance of a backlight in accordance with an input image. The technique thus controls the luminance of the backlight in accordance with an input image. This improves a display quality and reduces the electric power consumption.

CITATION LIST

Patent Literatures

Patent Literature 1

Japanese Patent Application Publication, Tokukai, No. 2000-347762 A (Publication Date: Dec. 15, 2000)

Patent Literature 2

Japanese Patent Application Publication, Tokukai, No. 2005-37685 A (Publication Date: Feb. 10, 2005)

SUMMARY OF INVENTION

Technical Problem

In order to further reduce electric power consumption of a liquid crystal display device, it can be considered combining the active backlight driving and the suspension driving with each other.

However, various problems will occur in a case where the active backlight driving and the suspension driving are merely combined with each other. One of the various problems is as follows: most driving circuits, in the liquid crystal display device, which include a driving circuit for driving a backlight, are being suspended during a suspension time period. Therefore, during the suspension time period, the backlight emits no light, and therefore display becomes dark. This ultimately deteriorates a display quality. Another problem is as follows: in a case where an identical image continues to be displayed from a driving time period to a suspension time period, the identical image flickers due to a change in luminance caused at a transition from the driving time period to the suspension time period. This ultimately deteriorates the display quality.

Further, another problem is as follows: according to the active backlight driving, the luminance of the backlight is controlled in accordance with an input image. Therefore, during a suspension time period during which no input image is newly inputted, the luminance of the backlight cannot be properly controlled, even if the backlight is to be turned on during the suspension time period. This possibly increases a difference in the luminance of the backlight between during a driving time period and during the suspension time period. Such increase in the difference will cause a defect such as flicker. This ultimately deteriorates the display quality.

The present invention was made in view of the problems, and an object of the present invention is to provide a display device which (i) displays an image by controlling a luminance of a backlight in accordance with an input image and alternating a driving time period and a suspension time period and (ii) eliminates flicker in screen at a transition from a driving time period to a suspension time period, thereby attaining a high display quality.

Solution to Problem

A display device of the present invention is configured to be a display device, including: a light source for irradiating a display panel with light; a light source luminance controlling section for controlling a luminance of the light source in accordance with a light source luminance control signal for controlling the luminance of the light source; a display controlling section for carrying out driving control with respect to the display panel; a suspension controlling section for controlling the display controlling section to be suspended for a predetermined period of time on a predetermined cycle; a light source control parameter calculating section for calculating a light source control parameter on the basis of gray scale information of an input image; a light source luminance control signal generating section for generating the light source luminance control signal on the basis of the light source control parameter; and a light source control parameter supplying section for supplying the light source control parameter to the light source luminance control signal generating section, the light source control parameter supplying section supplying, to the light source luminance control signal generating section during a suspension time period during which the suspension controlling section controls the display controlling section to be suspended, a light source control parameter which has been calculated, immediately before the suspension time period, by the light source control parameter calculating section.

According to the configuration, the light source control parameter supplying section supplies, to the light source luminance control signal generating section during the suspension time period, the light source control parameter which has been calculated, immediately before the suspension time period, by the light source control parameter calculating section. It is therefore possible to keep the luminance of the light source fixed from the time immediately before the suspension time period starts to the time when the suspension time period ends. This makes it possible to prevent flicker from occurring in a displayed image due to a difference in the luminance of the light source between immediately before the suspension time period and during the suspension time period. It is therefore possible to realize a display device having a high display quality.

As such, a display device, which displays an image by (i) controlling a luminance of a light source in accordance with an input image and (ii) alternating a driving time period and a suspension time period, can eliminate flicker in screen at a transition from the driving time period to the suspension time period, and can therefore attain a high display quality.

Advantageous Effects of Invention

A display device of the present invention is configured to be a display device, including: a light source for irradiating a back surface of a display panel with light; a light source luminance controlling section for controlling a luminance of the light source in accordance with a light source luminance control signal for controlling the luminance of the light source; a display controlling section for carrying out driving control with respect to the display panel; a suspension controlling section for controlling the display controlling section to be suspended for a predetermined period of time on a predetermined cycle; a light source control parameter calculating section for calculating a light source control parameter on the basis of gray scale information of an input image; a light source luminance control signal generating section for generating the light source luminance control signal on the basis of the light source control parameter; and a light source control parameter supplying section for supplying the light source control parameter to the light source luminance control signal generating section, the light source control parameter supplying section supplying, to the light source luminance control signal generating section during a suspension time period during which the suspension controlling section controls the display controlling section to be suspended, a light source control parameter which has been calculated, immediately before the suspension time period, by the light source control parameter calculating section.

As such, a display device, which displays an image by (i) controlling a luminance of a light source in accordance with an input image and (ii) alternating a driving time period and a suspension time period, can eliminate flicker in screen at a transition from the driving time period to the suspension time period, and can therefore attain a high display quality.

Figure 4:
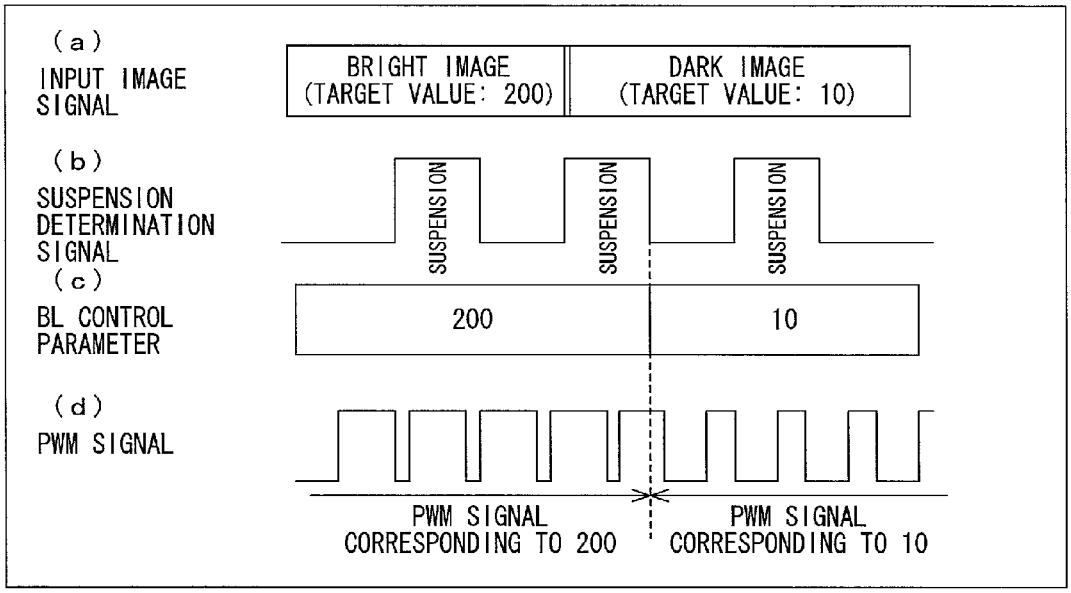

(a) of FIG. 4 is a view illustrating an input image signal. (b) of FIG. 4 is a view illustrating a waveform of a suspension determination signal. (c) of FIG. 4 is a view illustrating a BL control parameter. (d) of FIG. 4 is a view illustrating a waveform of a PWM signal.

Figure 5:
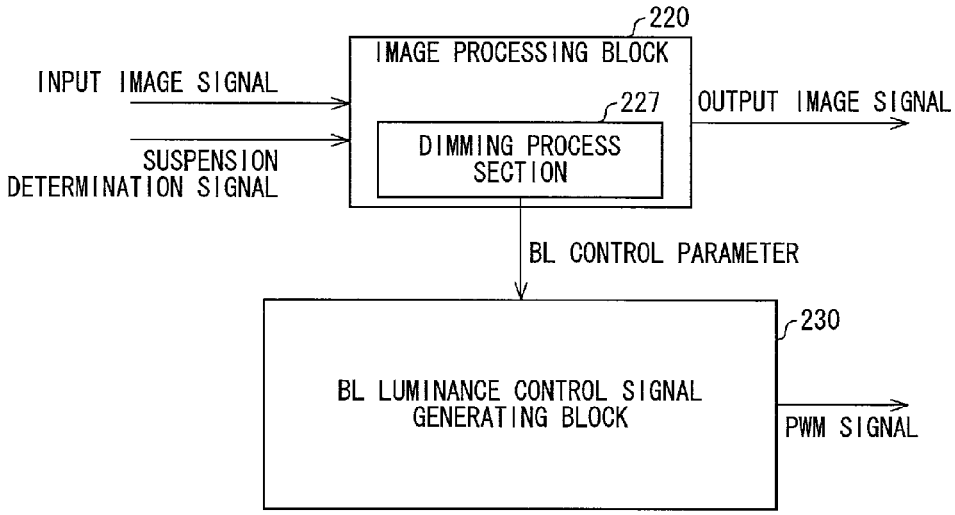

FIG. 5 is a block diagram clearly illustrating a relationship between an image processing block and a BL luminance control signal generating block which are included in a display device in accordance with Embodiment 2.

Figure 6:
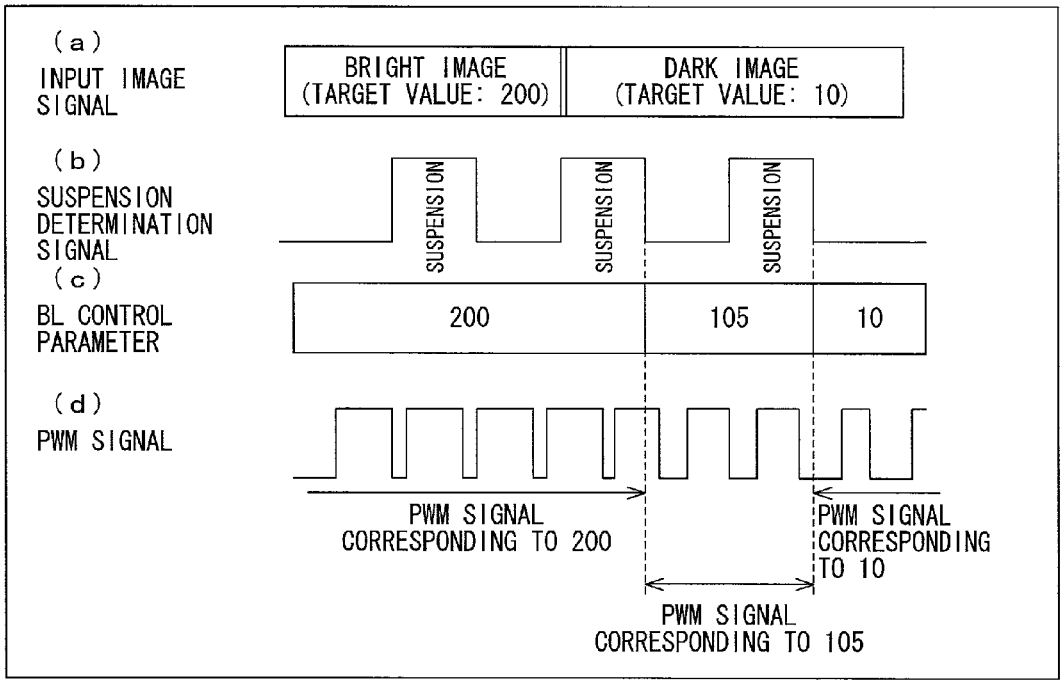

(a) of FIG. 6 is a view illustrating an input image signal. (b) of FIG. 6 is a view illustrating a waveform of a suspension determination signal. (c) of FIG. 6 is a view illustrating a BL control parameter. (d) of FIG. 6 is a view illustrating a waveform of a PWM signal.

Figure 7:
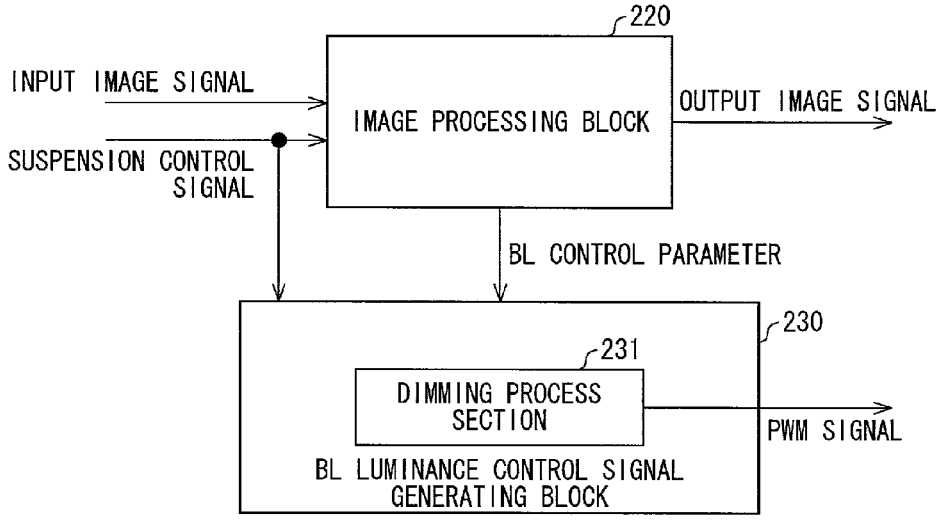

FIG. 7 is a block diagram clearly illustrating a relationship between an image processing block and a BL luminance control signal generating block which are included in a display device in accordance with Embodiment 3.

Figure 8:
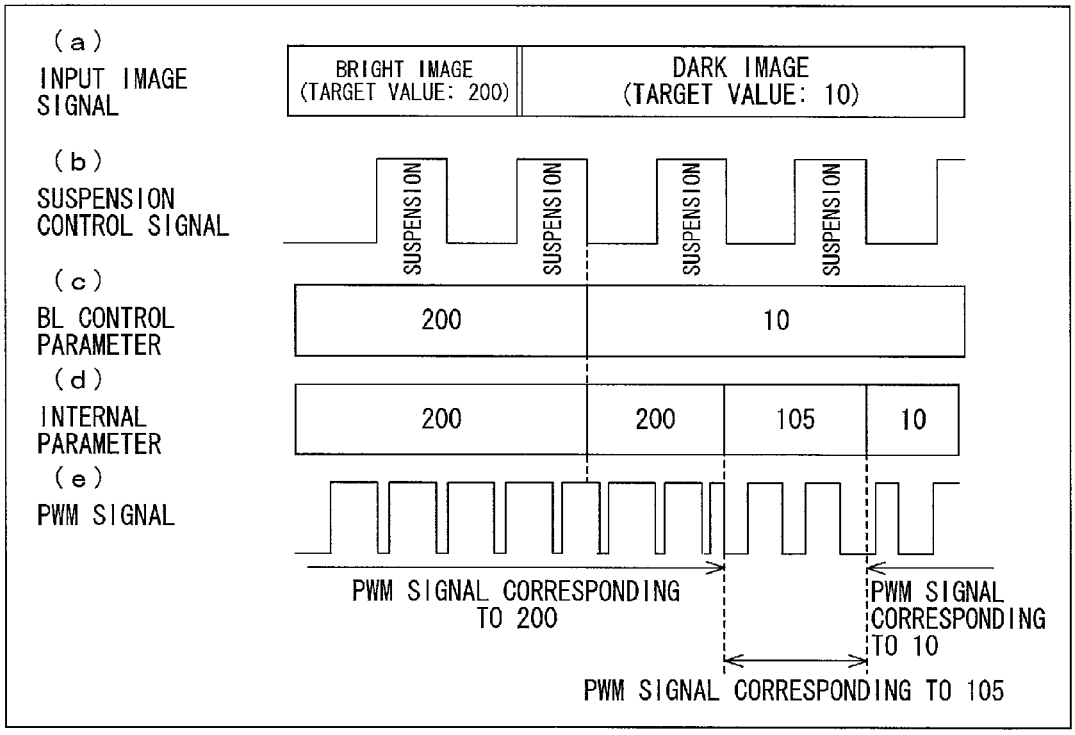

(a) of FIG. 8 is a view illustrating an input image signal. (b) of FIG. 8 is a view illustrating a waveform of a suspension determination signal. (c) of FIG. 8 is a view illustrating a BL control parameter. (d) of FIG. 8 is a view illustrating an internal parameter. (e) of FIG. 8 is a view illustrating a waveform of a PWM signal.

DESCRIPTION OF EMBODIMENTS

The following description will discuss in detail Embodiments of the present invention.

Embodiment 1

Embodiment 1 will be described as follows. Note that Embodiment 1 deals with, as an example, a display device which carries out a suspension driving. In the suspension driving, (i) a driving time period during which a display panel is driven and (ii) a suspension time period during which the display panel is not driven, are alternated on a predetermined cycle, so as to achieve low power consumption. Details of the suspension driving will be described later.

Figure 1:
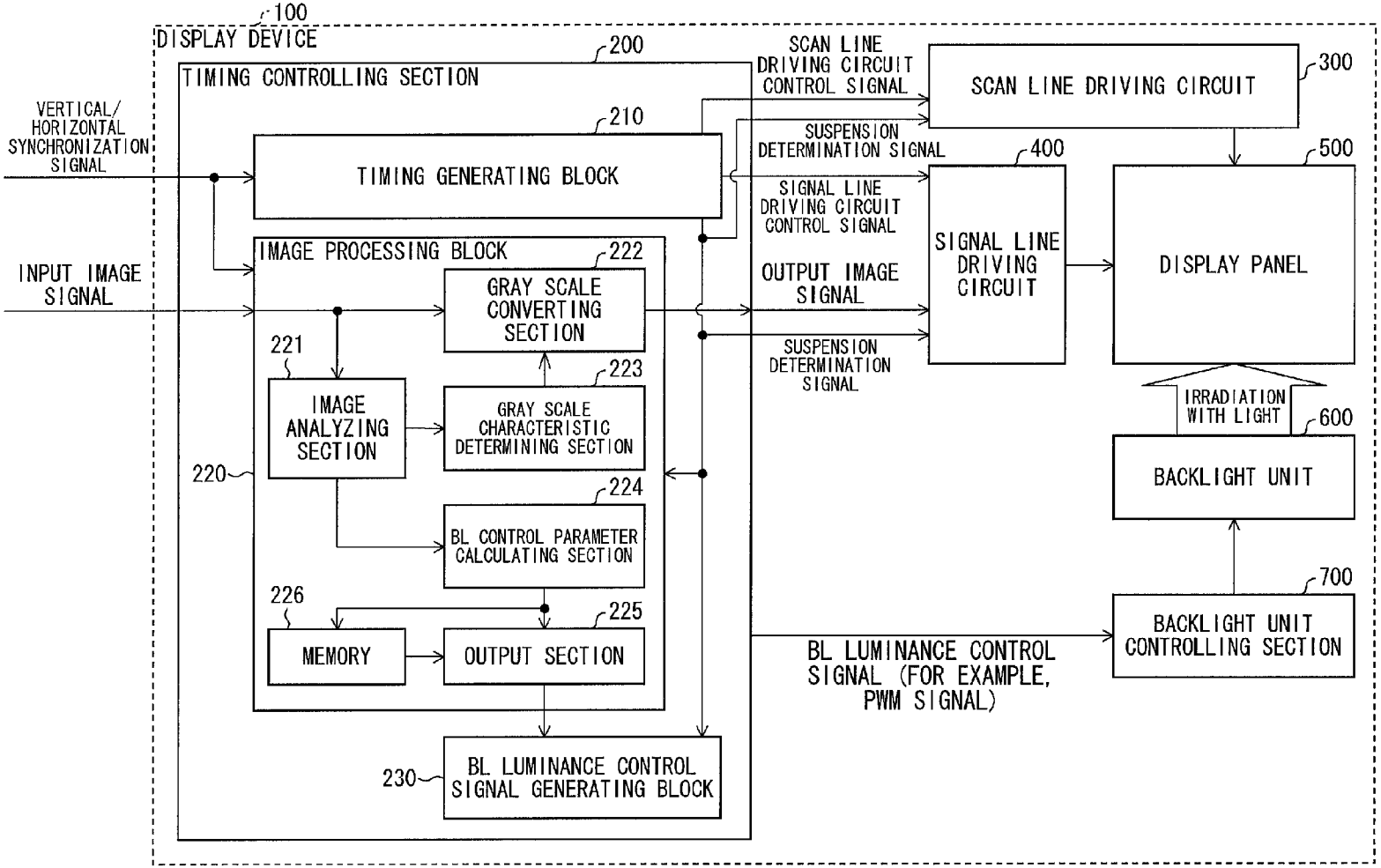
FIG. 1 is a block diagram schematically illustrating an overall configuration of a display device in accordance with Embodiment 1 of the present invention.

FIG. 1 is a block diagram schematically illustrating an overall configuration of a display device 100.

Figure 2:
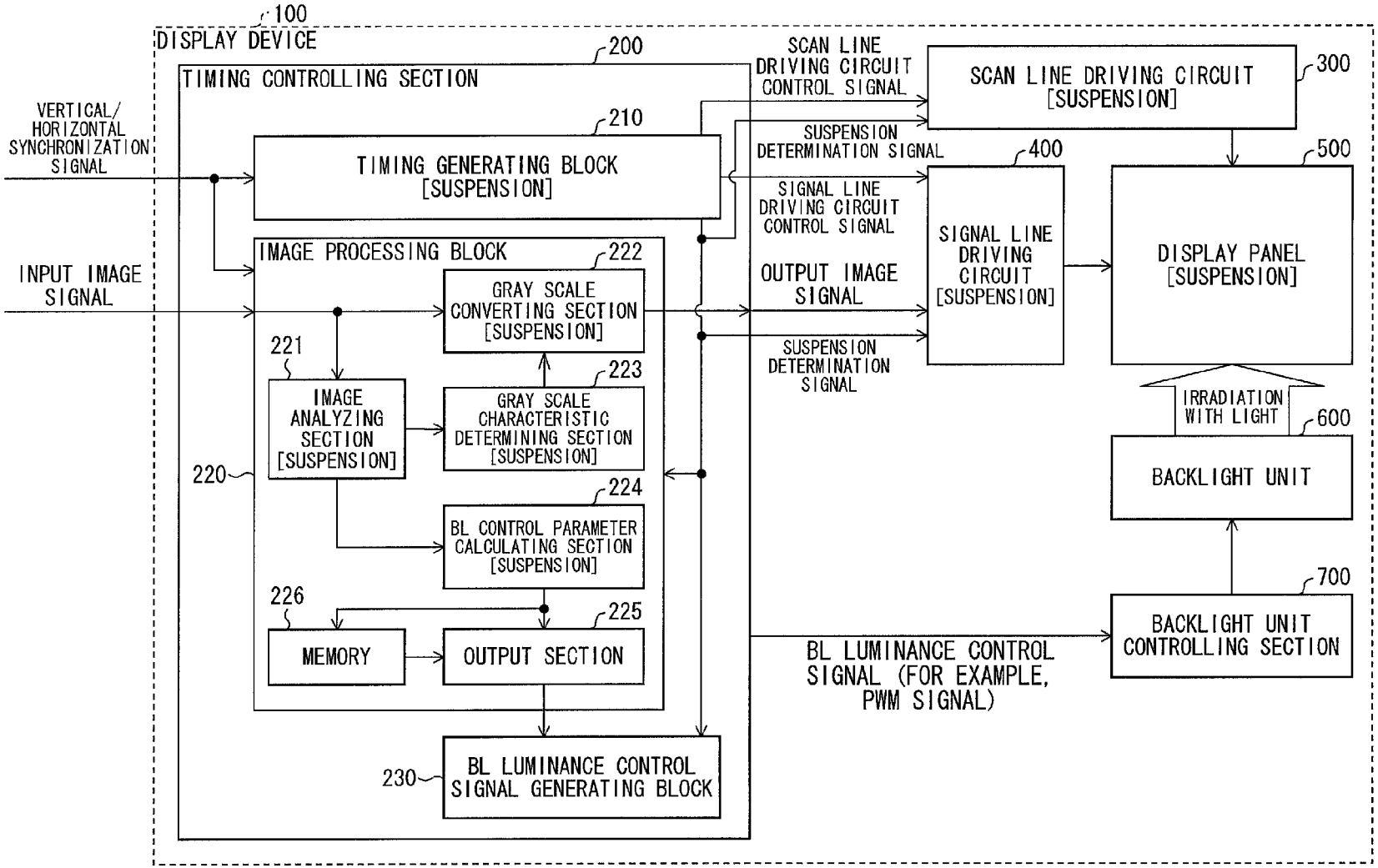
FIG. 2 is a block diagram schematically illustrating the overall configuration of the display device (illustrated in FIG. 1) which is being suspended.

FIG. 2 is a view illustrating what blocks are suspended, during a suspension time period, in the display device 100 (see FIG. 1). In FIG. 2, blocks, to which "suspension" is appended, will be suspended during the suspension time period.

(Description of Overall Configuration of Display Device 100)

The display device 100 includes a timing controlling section 200, a scan line driving circuit 300, a signal line driving circuit 400, a display panel 500, a backlight unit (light source) 600, and a backlight unit controlling section (light source luminance controlling section) 700 (see FIG. 1).

Note that, in Embodiment 1, the display panel 500 is exemplified by a liquid crystal display device that includes a liquid crystal display panel. The liquid crystal display panel includes (i) an active matrix substrate on which (a) TFTs arranged in a matrix manner and (b) pixel electrodes connected to the respective TFTs are provided, (ii) a counter substrate provided so as to face the pixel electrodes of the active matrix substrate, and (iii) a liquid crystal layer sandwiched between the active matrix substrate and the counter substrate.

(Timing Controlling Section 200)

The timing controlling section 200 includes a timing generating block (suspension controlling section) 210, an image processing block 220, and a BL luminance control signal generating block (light source luminance control signal generating section) 230. The timing controlling section 200 supplies, in response to vertical/horizontal synchronization signals and input image signals, (i) a scan line driving circuit control signal to the scan line driving circuit 300 and (ii) a signal line driving circuit control signal and an output image signal to the signal line driving circuit 400. Note that the timing controlling section 200 also supplies a suspension determination signal to the scan line driving circuit 300 and the signal line driving circuit 400. These signals will be later described in detail.

(Scan Line Driving Circuit 300)

The scan line driving circuit 300 controls, in response to a scan line driving circuit control signal supplied from the timing controlling section 200, each time period during which a corresponding one of the TFTs in the display panel 500 is turned ON. This causes the signal line driving circuit 400 (later described) to apply, at appropriate timing, voltages to the liquid crystal which constitutes the display panel 500.

Note that the scan line driving circuit 300 receives the suspension determination signal from the timing controlling section 200. The display panel 500 is subjected to suspension of driving in a time period during which the suspension determination signal has a high level (during a suspension time period).

(Signal Line Driving Circuit 400)

The signal line driving circuit 400 applies, in response to a signal line driving circuit control signal and an output image signal which have been supplied from the timing controlling section 200, various voltages to the display panel 500 in accordance with the output image signal. Note that the timing, at which the various voltages are applied, is determined depending on the time period, during which the scan line driving circuit 300 is in the ON state.

Note that the signal line driving circuit 400 receives a suspension determination signal from the timing controlling section 200. The signal line driving circuit 400 carries out suspension of driving of the display panel 500 in a time period during which the suspension determination signal has a high level (during a suspension time period).

(Display Panel 500)

The display panel 500 is realized by the above-described liquid crystal display panel. The display panel 500 displays an image in response to voltages applied by the signal line driving circuit 400. Note that the display panel 500 stops being driven (i.e., is in a suspended state) during a suspension time period because no voltage is applied to the display panel 500 during the suspension time period by the signal line driving circuit 400 and the scan line driving circuit 300. Note, however, that the display panel 500 can keep displaying, even during the suspension time period, an image displayed immediately before the suspension time period. This is because the liquid crystal that constitutes the display panel 500 has a hold function. Therefore, it appears that the display panel 500 is not in a suspended state. In order that the display panel 500 properly displays an image during the suspension time period, it is therefore necessary that the backlight unit 600 is not in a suspended state.

(Backlight Unit 600)

The backlight unit 600 is provided so as to backlight the display panel 500.

In the backlight unit 600, a plurality of LEDs are employed as a light source. Specifically, a direct LED backlight device is employed in which a plurality of LEDs are arranged in a planar manner behind the display panel 500. According to the direct LED backlight device, it is possible to easily adjust a luminance of an entire backlight section by adjusting luminances of the respective LEDs. Note that signals, which are used to adjust the luminances of the respective LEDs, are supplied from the backlight controlling section 700.

Note that the backlight unit 600 is not limited to the direct LED backlight device. Alternatively, an LED backlight device of edge light type can be employed which is provided on a side of the display panel 500.

An example case has been described where the plurality of LEDs are employed, as the light source, in the backlight unit 600. Note, however, that the light source of the backlight unit 600 is not limited to such plurality of LEDs. Alternatively, an existing light source such as a cold-cathode tube or a hot-cathode tube can be employed as the light source, provided that a luminance of such an existing light source can be adjusted.

(Backlight Unit Controlling Section 700)

The backlight unit controlling section 700 generates, in response to the BL luminance control signal supplied form the timing controlling section 200, a signal which is used to adjust the luminance of the backlight unit 600 (signals used to adjust the luminances of the respective LEDs). Then, the backlight unit controlling section 700 supplies a generated signal to the backlight unit 600.

The following description will discuss in detail the timing controlling section 200.

(Timing Generating Block 210)

In response to vertical/horizontal synchronization signals, the timing generating block 210 generates, as timing signals, a scan line driving circuit control signal and a signal line driving circuit control signal. Then, the timing generating block 210 supplies the scan line driving circuit control signal and the signal line driving circuit control signal to the scan line driving circuit 300 and the signal line driving circuit 400, respectively.

The timing generating block 210 also generates a suspension determination signal as an instruction signal for instructing the image processing block 220 (display controlling section; later described) to be suspended for a predetermined period of time on a predetermined cycle. Specifically, the timing generating block 210 generates, in response to supplied vertical/horizontal synchronization signals, a suspension determination signal that determines whether or not most blocks in the display device 100 should be suspended during a suspension time period. Then, the timing generating block 210 supplies the suspension determination signal to the image processing block 220, the scan line driving circuit 300, the signal line driving circuit 400, and the BL luminance control signal generating block 230. The suspension determination signal is a binary signal of a high level or a low level. Specifically, in a case where the suspension determination signal has a high level, (i) some of the image processing block 220, (ii) the scan line driving circuit 300, and (iii) the signal line driving circuit 400, are suspended.

Note that (i) the BL luminance control signal generating block 230 and (ii) an output section 225 of the image processing block 220 via which BL control parameters continue to be supplied to the BL luminance control signal generating block 230, will never be suspended, regardless of whether a supplied suspension determination signal has a high level or a low level.

That is, according to Embodiment 1, image processing-related blocks and circuits, in the display device 100, are suspended during a period of time during which the suspension determination signal has a high level, in other words, during a suspension time period. In contrast, backlight-related blocks and circuits, in the display device 100, are not suspended during such a period of time, i.e., the suspension time period.

Note that how to determine will be described later as to (i) a time period (suspension time period), during which a suspension determination signal has a high level and (ii) a time period (driving time period), during which a suspension determination signal has a low level.

(Image Processing Block 220)

The image processing block 220 is a block (display controlling section) which generates, in response to an input image signal, an output image signal to which an image processing has been subjected so that the display panel 500 can properly display an image. The image processing block 220 includes an image analyzing section 221, a gray scale converting section 222, a gray scale characteristic determining section 223, a BL control parameter calculating section (light source control parameter calculating section) 224, the output section (light source control parameter supplying section) 225, and a memory 226.

(Image Analyzing Section 221)

The image analyzing section 221 (i) analyzes a brightness of an entire image based on a supplied input image signal and then (ii) supplies an image analysis result to the gray scale characteristic determining section 223 and the BL control parameter calculating section 224. Note here that the analyzing of the brightness of the entire image indicates that a parameter indicative of the brightness of the entire image is extracted from an image signal corresponding to one (1) frame. The brightness of the entire image can be, for example, (i) a brightness of each of predetermined regions into which an image, corresponding to one (1) frame, is divided or (ii) an average gray scale or a maximum gray scale of an input image signal corresponding to one (1) frame.

(Gray Scale Characteristic Determining Section 223)

The gray scale characteristic determining section 223 (i) determines a gray scale characteristic of an entire image, corresponding to one (1) frame, based on an image analysis result which has been supplied from the image analyzing section 221 and then (ii) supplies determined gray scale characteristic information (gray scale information) to the gray scale converting section 222. Note here that the gray scale characteristic of the entire image, corresponding to one (1) frame, indicates characteristic information on what tendency the brightness of the entire image has.

(Gray Scale Converting Section 222)

The gray scale converting section 222 (i) converts a gray scale of the input image signal on the basis of the gray scale characteristic information which has been supplied from the gray scale characteristic determining section 223 and then (ii) supplies, to the signal line driving circuit 400, as an output image signal, the input image signal whose gray scale has been converted. Note here that the converting of the gray scale indicates that the gray scale of the input image signal is converted into a gray scale at which the display panel 500 properly displays an image.

(BL Control Parameter Calculating Section 224)

The BL control parameter calculating section 224 (i) calculates, for each frame, a BL control parameter based on the image analysis result which has been supplied from the image analyzing section 221 and then (ii) supplies the BL control parameter to the output section 225 and the memory 226. Note here that the BL control parameter indicates a parameter to be used, in the BL luminance control signal generating block 230, to generate a BL luminance control signal which causes a change in luminance of the backlight unit 600.

(Memory 226)

In the memory 226, BL control parameters, which have been calculated by the BL control parameter calculating section 224, are sequentially stored in association with respective frames. Note that the memory 226 is not limited to a specific one, provided that data can be written into or read out from the storage medium.

(Output Section 225)

The output section 225 supplies, to the BL luminance control signal generating block 230, a BL control parameter which has been calculated by the BL control parameter calculating section 224.

Note that, in a case where the BL control parameter calculating section 224 is being suspended during a suspension time period, no BL control parameter is supplied to the output section 225 from the BL control parameter calculating section 224. And so, the output section 225 supplies, to the BL luminance control signal generating block 230, a BL control parameter stored in the memory 226. Note here that, in reading out a BL control parameter from the memory 226, the output section 225 (i) designates a frame to be read out and then (ii) reads out the BL control parameter associated with a designated frame. According to Embodiment 1, the output section 225 thus (i) designates a frame immediately before a suspension time period and then (ii) reads out a BL control parameter associated with a designated frame.

As such, the output section 225 always continues to supply BL control parameters to the BL luminance control signal generating block 230, regardless of during a suspension time period or during a driving time period.

(BL Luminance Control Signal Generating Block 230)

The BL luminance control signal generating block 230 (i) generates a BL luminance control signal on the basis of a BL control parameter that has been supplied from the output section 225 and then (ii) supplies the BL luminance control signal to the backlight unit controlling section 700. Embodiment 1 will describe an example in which a PWM (Pulse Width Modulation) signal is employed as a BL luminance control signal. The reason why the PWM signal is employed is that a duty ratio can be easily adjusted by adjusting a pulse width, that is, an ON time period and an OFF time period of the PWM signal. That is, usage of the PWM signal makes it easy to adjust the luminance of the backlight unit 600. The PWM signal is particularly suitable for a light source, such as LEDs, whose luminance is easily adjusted.

(Suspension Driving)

As early described, the display device 100 of Embodiment 1 is configured to carry out the suspension driving. In the suspension driving, (i) a driving time period during which the display panel is driven and (ii) a suspension time period during which the display panel is not driven, are alternated on a predetermined cycle.

Further, as early described, the suspension time period is a time period during which a suspension determination signal to be outputted from the timing generating block 210 has a high level, and the driving time period is a time period during which the suspension determination signal has a low level.

Note that it is possible to arbitrarily set (i) a suspension time period, (ii) a driving time period, and (iii) a cycle on which the suspension time period and the driving time period are alternated.

Blocks and circuits, in the display device 100 having the above configuration, which are suspended during a suspension time period, are (i) the timing generating block 210, the image analyzing section 221, the gray scale converting section 222, the gray scale characteristic determining section 223, and the BL control parameter calculating section 224, all of which are included in the timing controlling section 200, (ii) the scan line driving circuit 300, (iii) the signal line driving circuit 400, and (iv) the display panel 500 (see FIG. 2). In contrast, blocks and circuits, in the display device 100, which are driven during the suspension time period, are the output section 225, the memory 226, the BL luminance control signal generating block 230, the backlight unit 600, and the backlight unit controlling section 700.

In the display device 100 of Embodiment 1, (i) image processing-related blocks and circuits, each of which has a relatively high power consumption, are suspended during a suspension time period, whereas (ii) backlight-related blocks and circuits continue to be driven during the suspension time period.

Note that, in a case where the backlight-related blocks and the circuits continue, without any countermeasure, to be driven regardless of during a suspension time period or a driving time period, luminance of the backlight unit does not become an appropriate one, at a transition from a driving time period to a suspension time period. This may cause a defect such as flicker in screen.

The following description will discuss how to prevent a defect, such as flicker in screen, from occurring by appropriately adjusting the luminance of the backlight unit, in a case where the backlight-related blocks and the circuits continue to be driven during a suspension time period.

(Backlight Driving Control)

Figure 3:
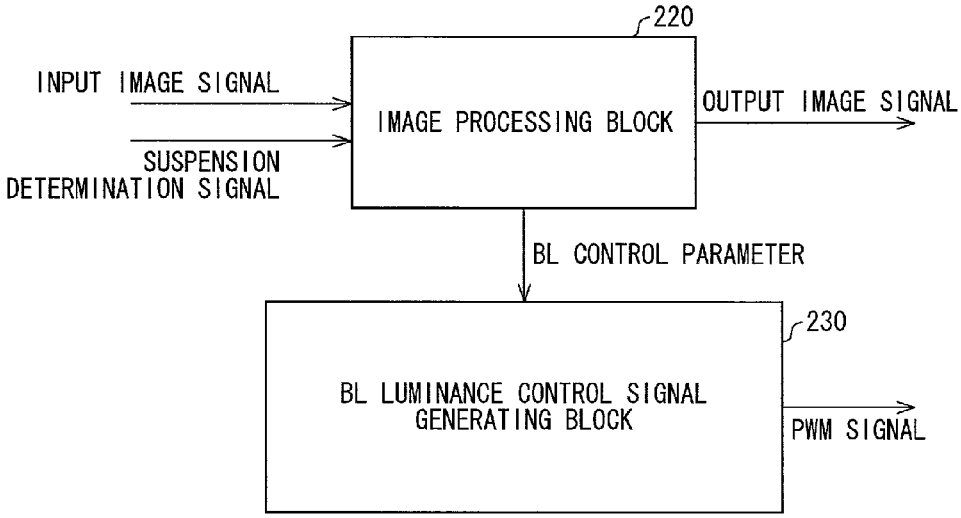
FIG. 3 is a block diagram clearly illustrating a relationship between an image processing block and a BL luminance control signal generating block which are included in the display device in accordance with Embodiment 1.

FIG. 3 is a view schematically illustrating a relationship between the image processing block 220 and the BL luminance control signal generating block 230 which are illustrated in FIG. 1.

(a) through (d) of FIG. 4 are views illustrating a relationship among an input image signal, a suspension determination signal, a BL control parameter, and a PWM signal, all of which are illustrated in FIG. 3.

The image processing block 220 receives an input image signal and a suspension determination signal (see FIG. 3). Note here that the input image signal contains a signal corresponding to bright image (target value: 200) and a signal corresponding to dark image (target value: 10), as illustrated in (a) of FIG. 4. Note also that (i) the suspension determination signal is a binary signal of a high level or a low level and (ii) a suspension time period (high level) and a driving time period (low level) are alternated on a predetermined cycle (see (b) of FIG. 4). According to Embodiment 1, timing of a transition from bright image to dark image is in synchronization with a rising edge of a suspension time period.

According to Embodiment 1, the timing of a transition from bright image to dark image is thus in synchronization with a rising edge of the suspension time period. Embodiment 1 is not, however, limited to this. This is because the output section 225 supplies, in principle, a BL control parameter in synchronization with a change in the suspension determination signal, regardless of timing of transition in input image.

In a case where timing of transition from bright image to dark image is not in synchronization with a rising edge of a suspension time period, the output section 225 merely needs to output a BL control parameter in synchronization with timing of transition in the input image. In this case, at least the luminance of the backlight unit 600 is changed at an appropriate timing that is synchronized with the timing of transition in the input image.

The image processing block 220 (i) analyzes an input image signal, (ii) causes the input image signal to be subjected to image processing so as to calculate a BL control parameter, and then (iii) supplies the BL control parameter to the BL luminance control signal generating block 230 (see FIG. 3). Note here that the BL control parameter has (i) a value (200) corresponding to the target value (200) of the bright image or (ii) a value (10) corresponding to the target value (10) of the dark image.

During a suspension time period, the image processing block 220 outputs a BL control parameter that corresponds to a frame (adjacent frame) immediately before the suspension time period. As such, during a suspension time period (while a suspension determination signal has a high level), even in a case where a transition occurs from bright image to dark image, the image processing block 220 outputs, as a BL control parameter that corresponds to the frame immediately before the suspension time period, a BL control parameter which has the value (200) corresponding to the target value 200 (see (c) of FIG. 4).

The BL luminance control signal generating block 230 outputs a PWM signal that corresponds to a BL control parameter supplied from the image processing block 220 (see FIG. 3). Specifically, the BL luminance control signal generating block 230 outputs a PWM signal that corresponds to the target value 200, during a period of time during which a BL control parameter corresponds to the target value 200 (see (d) of FIG. 4). When the suspension time period ends after a transition from bright image to dark image, the BL luminance control signal generating block 230 outputs a PWM signal corresponding to the target value 10. This is because the target value is changed into 10 from 200 (see (d) of FIG. 4).

In a case where the image processing block 220 receives a suspension determination signal of a high level (during a suspension time period), (i) the image processing-related blocks (the image analyzing section 221, the gray scale converting section 222, the gray scale characteristic determining section 223, and the BL control parameter calculating section 224) in the image processing block 220 are suspended, and in contrast, (ii) the backlight driving-related blocks (the output section 225 and the memory 226) in the image processing block 220 are not suspended (see FIG. 2).

Therefore, even during the suspension time period, the image processing block 220 thus continues to supply BL control parameters to the BL luminance control signal generating block 230. Note here that the BL control parameters to be supplied from the image processing block 220 during the suspension time period are a BL control parameter (data stored in the memory 226) corresponding to a frame immediately before the suspension time period.

Accordingly, during the suspension time period, the BL luminance control signal generating block 230 continues to (i) generate a PWM signal in accordance with the BL control parameter corresponding to the frame immediately before the suspension time period and then (ii) supply the PWM signal to the backlight unit controlling section 700 (see FIG. 2).

Since the PWM signal is thus always outputted in accordance with the BL control parameter even during a suspension time period, no defect in display is caused by the fact that no PWM signal is outputted during the suspension time period.

A PWM signal, to be outputted during a suspension time period, is a PWM signal which corresponds to a frame immediately before the suspension time period. As such, a displayed image has a luminance which does not cause a viewer to feel odd even in a case where a driving time period is changed to the suspension time period.

As is clear from above, it is possible to eliminate flicker in screen at a transition from a driving time period to a suspension time period, in a case where an image is displayed by (i) controlling a luminance of a backlight unit in accordance with an input image and (ii) alternating a driving time period and a suspension time period, so as to reduce power consumption, like the display device having the above configuration. This ultimately allows a high display quality to be achieved.

Note that, in a case where (i) a liquid crystal panel is employed as the display panel 500 and (ii) the liquid crystal panel is controlled to make a transition from bright image to dark image, such a transition is gradually made due to a response speed of liquid crystal. Therefore, according to Embodiment 1, after a transition from bright image to dark image, the backlight unit has, during a suspension time period, a luminance based on a PWM signal which corresponds to a frame immediately before the suspension time period. Thus, the luminance does not change during the suspension time period, and then a BL control parameter is changed so as to correspond to the target 10 from the target value 200 after completion of a response of the liquid crystal. The time, when the luminance of the backlight unit starts changing, thus comes later than the time when the transition occurs from bright image to dark image. This allows (i) the time when the dark image is actually displayed and (ii) the time when the luminance of the backlight unit is changed, to substantially come together. Consequently, no flicker in screen will occur in a displayed image when the luminance of the backlight unit changes.

Note, however, that the above countermeasure cannot fully address a case where there is a great difference in luminance between images before and after changing of the images. That is, in such a case, it appears that a luminance of the backlight unit has quickly changed. This causes flicker in screen due to such a great difference in luminance.

In view of the circumstances, an example, in which a luminance of a backlight is not quickly changed but is gradually changed after a suspension time period, will be described below in Embodiments 2 and 3.

Embodiment 2

Embodiment 2 of the present invention will be described below.

Note that, for convenience, like reference numerals herein refer to corresponding members having like functions in the drawings of Embodiment 1, and descriptions of such members are omitted here.

(Dimming Process)

Embodiment 2 will describe an example in which a dimming process is carried out so that a luminance of a backlight is not quickly changed but is gradually changed after a suspension time period.

FIG. 5 is a view schematically illustrating a relationship between an image processing block 220 and a BL luminance control signal generating block 230.

(a) through (d) of FIG. 6 are views illustrating a relationship among an input image signal, a suspension determination signal, a BL control parameter, and a PWM signal, all of which are illustrated in FIG. 5.

The image processing block 220 includes a dimming process section 227 (see FIG. 5).

Assume that the diming process section 227 is provided between the BL control parameter calculating section 224 and the output section 225 which are illustrated in FIG. 1 of Embodiment 1.

The dimming process section 227 carries out a dimming process with respect to a BL control parameter to be supplied from a BL control parameter calculating section 224. Details of the dimming process will be described later.

The image processing block 220 receives an input image signal and a suspension determination signal. Note here that the input image signal contains a signal corresponding to bright image (target value: 200) and a signal corresponding to dark image (target value: 10), as illustrated in (a) of FIG. 6. Note also that (i) the suspension determination signal is a binary signal of a high level or a low level and (ii) a suspension time period (high level) and a driving time period (low level) are alternated on a predetermined cycle (see (b) of FIG. 6). According to Embodiment 2, timing of a transition from bright image to dark image is in synchronization with a rising edge of a suspension time period.

The image processing block 220 (i) analyzes an input image signal and (ii) causes the input image signal to be subjected to image processing so as to calculate a BL control parameter. The dimming process section 227 carries out a dimming process with respect to the BL control parameter. The image processing block 220 supplies, to a BL luminance control signal generating block 230, the BL control parameter which has been subjected to the dimming process (see FIG. 5). Note here that the BL control parameter, which is calculated before being subjected to the dimming process, has (i) a value (200) corresponding to the target value (200) of the bright image or (ii) a value (10) corresponding to the target value (10) of the dark image. The dimming process section 227 (i) calculates a target value 105 by averaging the target value 200 and the target value 10 (see (c) of FIG. 6) and (ii) outputs a BL control parameter which has a value (105) corresponding to the target value 105.

Specifically, during a suspension time period, the image processing block 220 outputs a BL control parameter that corresponds to a frame immediately before the suspension time period. As such, during a suspension time period (while a suspension determination signal has a high level), even in a case where a transition occurs from bright image to dark image, the image processing block 220 outputs, as a BL control parameter that corresponds to the frame immediately before the suspension time period, a BL control parameter which has the value (200) corresponding to the target value 200. During a time period from the time immediately after the suspension time period ends to the time when a subsequent suspension time period ends, the image processing block 220 outputs, as a BL control parameter having an intermediate value, a BL control parameter which has the value corresponding to the target value 105 (see (c) of FIG. 6).

Note that, according to Embodiment 2, the intermediate value between the target value 200 and the target value 10 is the average value 105. The intermediate value is, however, not limited to such, provided that it falls within a range between the two target values.

An intermediate value can be calculated, for example, by (i) determining a dimming time period (N frame(s)), (ii) dividing, by N, a difference (D) between a current value and a target value, and (iii) changing a value by D/N for each of the N frame(s) (note that a recalculation will be made in a case where a target value is changed). Such values thus changed are each used as the intermediate value.

The BL luminance control signal generating block 230 outputs a PWM signal that corresponds to a BL control parameter supplied from the image processing block 220 (see FIG. 5). Specifically, the BL luminance control signal generating block 230 outputs a PWM signal that corresponds to the target value 200, during a period of time during which a BL control parameter corresponds to the target value 200 (see (d) of FIG. 6). When the suspension time period ends after a transition from bright image to dark image, the BL luminance control signal generating block 230 outputs a PWM signal corresponding to the target value 105. This is because the target value is changed into 105 from 200. When the subsequent suspension time period ends, the BL luminance control signal generating block 230 outputs a PWM signal corresponding to the target value 10. This is because the target value is changed into 10 from 105.

In a case where the image processing block 220 receives a suspension determination signal of a high level (during a suspension time period), (i) image processing-related blocks (an image analyzing section 221, a gray scale converting section 222, a gray scale characteristic determining section 223, and the BL control parameter calculating section 224) in the image processing block 220 are suspended, and in contrast, (ii) backlight driving-related blocks (an output section 225 and a memory 226) in the image processing block 220 are not suspend (see FIG. 2).

Therefore, even during the suspension time period, the image processing block 220 thus continues to supply BL control parameters to the BL luminance control signal generating block 230. Note here that the BL control parameters to be supplied from the image processing block 220 during the suspension time period are a BL control parameter (data stored in the memory 226) corresponding to a frame immediately before the suspension time period.

Accordingly, during the suspension time period, the BL luminance control signal generating block 230 continues to (i) generate a PWM signal in accordance with the BL control parameter corresponding to the frame immediately before the suspension time period and then (ii) supply the PWM signal to a backlight unit controlling section 700 (see FIG. 2).

Since the PWM signal is thus always supplied in accordance with the BL control parameter even during a suspension time period, no defect in display is caused by the fact that no PWM signal is outputted during the suspension time period.

A PWM signal, to be outputted during a suspension time period, is a PWM signal which corresponds to a frame immediately before the suspension time period. As such, a displayed image has a luminance which does not cause a viewer to feel odd even is a case where a driving time period is changed to the suspension time period.

As is clear from above, it is possible to eliminate flicker in screen at a transition from a driving time period to a suspension time period, in a case where an image is displayed by (i) controlling a luminance of a backlight in accordance with an input image and (ii) alternating a driving time period and a suspension time period, so as to reduce power consumption, like the display device having the above configuration. This ultimately allows a high display quality to be achieved.

Note that, at a transition from bright image to dark image, the image processing block 220 outputs, during the first suspension time period, the BL control parameter corresponding to a frame immediately before the first suspension time period. During the time period from the time when the first suspension time period ends to the time when the second suspension time period ends, at the transition from bright image to dark image, the image processing block 220 does not immediately output a BL control parameter corresponding to the dark image but outputs a BL control parameter corresponding to an intermediate value. Therefore, in a case where there is a remarkable difference in brightness between an image which has not changed and an image which has changed, it is therefore possible to reduce flicker in screen that occurs in a case where the brightness is changed.

Note that according to Embodiment 2, a dimming process is carried out in the image processing block 220. The dimming process is, however, not limited to such. The diming process can alternatively be carried out in the BL luminance control signal generating block 230. An example case, where a dimming process is carried out in the BL luminance control signal generating block 230, will be described below in Embodiment 3.

Embodiment 3

The following description will discuss Embodiment 3 of the present invention.

Note that, for convenience, like reference numerals herein refer to corresponding members having like functions in the drawings of Embodiment 1, and descriptions of such members are omitted here.

(Dimming Process)

Embodiment 3 will describe an example in which a dimming process is carried out so that a luminance of a backlight is not quickly changed but is gradually changed after a suspension time period.

FIG. 7 is a view schematically illustrating a relationship between an image processing block 220 and a BL luminance control signal generating block 230.

(a) through (d) of FIG. 8 are views illustrating a relationship among an input image signal, a suspension determination signal, a BL control parameter, and a PWM signal, all of which are illustrated in FIG. 7.

Note here that Embodiment 3 is different from Embodiment 2 in that a dimming process is carried out not in the image processing block 220 but in the BL luminance control signal generating block 230. That is, according to Embodiment 3, the BL luminance control signal generating block 230 includes a dimming process section 231 (see FIG. 7).

The diming process section 231 is followed by a circuit, in the BL luminance control signal generating block 230, which circuit generates a PWM signal. That is, upon receipt of a BL control parameter, the BL luminance control signal generating block 230 (i) converts the BL control parameter into an internal parameter, (ii) generates a PWM signal so as to correspond to the internal parameter, and then (iii) outputs the PWM signal. It is the diming process section 231 that generates the internal parameter.

The image processing block 220 receives an input image signal and a suspension determination signal. Note here that the input image signal contains a signal corresponding to bright image (target value: 200) or a signal corresponding to dark image (target value: 10), as illustrated in (a) of FIG. 8. Note also that (i) the suspension determination signal is a binary signal of a high level or a low level and (ii) a suspension time period (high level) and a driving time period (low level) are alternated on a predetermined cycle (see (b) of FIG. 8). According to Embodiment 3, timing of a transition from bright image to dark image is in synchronization with a rising edge of a suspension time period.

The image processing block 220 (i) analyzes an input image signal, (ii) causes the input image signal to be subjected to image processing so as to calculate a BL control parameter, and then (iv) supplies the BL control parameter to the BL luminance control signal generating block 230 (see FIG. 7). Note here that the BL control parameter has (i) a value (200) corresponding to the target value (200) of the bright image or (ii) a value (10) corresponding to the target value (10) of the dark image.

During a suspension time period, the image processing block 220 outputs a BL control parameter that corresponds to a frame immediately before the suspension time period. As such, during a suspension time period (while a suspension determination signal has a high level), even in a case where a transition occurs from bright image to dark image, the image processing block 220 outputs, as a BL control parameter that corresponds to the frame immediately before the suspension time period, a BL control parameter which has the value (200) corresponding to the target value 200 (see (c) of FIG. 8).

The BL luminance control signal generating block 230 (i) receives the suspension determination signal which is identical to that to be supplied to the image processing block 220, in addition to the BL control parameter and (ii) outputs a PWM signal that varies depending on an internal parameter which has been subjected to a dimming process by the dimming process section 231 (see FIG. 7).

The dimming process section 231 generates an internal parameter (see (d) of FIG. 8) on the basis of a BL control parameter (see (c) of FIG. 8) which has been supplied from the image processing block 220. Specifically, in a case where a BL control parameter corresponds to the target value 200, the dimming process section 231 outputs a PWM signal corresponding to the target value 200 of the internal parameter (see (d) of FIG. 8). Then, the BL control parameter is changed so as to correspond to the target value 105 from the target value 200 when a first suspension time period ends after a transition from bright image to dark image. Note, however, that the internal parameter keeps an internal parameter which corresponds to the target value 200 until a second suspension time period ends. When the second suspension time period ends, the dimming process section 231 generates an internal parameter corresponding to the target value 105 that is an intermediate value between the target value of the bright image and the target value of the dark image. When a third suspension time period ends, the dimming process section 231 generates an internal parameter corresponding to a BL control parameter that corresponds to the target value 10 of the dark image. Note that the first through third suspension time periods come in this order.

As such, the BL luminance control signal generating block 230 (i) generates PWM signals corresponding to the respective internal parameters which have been generated by the dimming process section 231 (see (e) of FIG. 8) and (ii) outputs the PWM signals.

In a case where the image processing block 220 receives a suspension determination signal of a high level (during a suspension time period), (i) image processing-related blocks (an image analyzing section 221, a gray scale converting section 222, a gray scale characteristic determining section 223, and a BL control parameter calculating section 224) in the image processing block 220 are suspended, and in contrast, (ii) backlight driving-related blocks (an output section 225 and a memory 226) in the image processing block 220 are not suspended (see FIG. 2).

Therefore, even during the suspension time period, the image processing block 220 thus continues to supply BL control parameters to the BL luminance control signal generating block 230. Note here that the BL control parameters to be supplied from the image processing block 220 during the suspension time period are a BL control parameter (data stored in the memory 226) corresponding to a frame immediately before the suspension time period.

Accordingly, during the suspension time period, the BL luminance control signal generating block 230 continues to (i) generate a PWM signal in accordance with the BL control parameter corresponding to the frame immediately before the suspension time period and then (ii) supply the PWM signal to a backlight unit controlling section 700 (see FIG. 2).

Since the PWM signal is thus always supplied in accordance with the BL control parameter even during a suspension time period, no defect in display is caused by the fact that no PWM signal is outputted during the suspension time period.

A PWM signal, to be outputted during a suspension time period, is a PWM signal which corresponds to a frame immediately before the suspension time period. As such, a displayed image has a luminance which does not cause a viewer to feel odd even is a case where a driving time period is changed to the suspension time period.

As is clear from above, it is possible to eliminate flicker in screen at a transition from a driving time period to a suspension time period, in a case where an image is displayed by (i) controlling a luminance of a backlight in accordance with an input image and (ii) alternating a driving time period and a suspension time period, so as to reduce power consumption, like the display device having the above configuration. This ultimately allows a high display quality to be achieved.

Note that, at a transition from bright image to dark image, the image processing block 220 outputs, during the first suspension time period, the PWM signal corresponding to a frame immediately before the first suspension time period. During the time period from the time when the first suspension time period ends to the time when the second suspension time period ends, the image processing block 220 does not immediately output a BL control parameter corresponding to the dark image but outputs a BL control parameter corresponding to an intermediate value. Therefore, in a case where there is a remarkable difference in brightness between an image which has not changed and an image which has changed, it is therefore possible to reduce flicker in screen that occurs in a case where the brightness is changed.

Note that Embodiments 1 through 3 each have assumed that the display panel 500 is realized by a liquid crystal panel. Embodiments 1 through 3, however, are not limited to such an assumption. The present invention is applicable to any display devices which display an image by means of backlight.

Note also that Embodiments 1 through 3 each have described a case where a backlight unit irradiates the display panel 500 with light. Embodiments 1 through 3, however, are not limited to such a case. A device, which emits light to a front surface of the display panel 500, can be alternatively employed.

The display device of the present invention can be configured such that at timing of transition from a first image to a second image, the first and second images having respective different gray scales obtained from gray scale information of an input image, the light source control parameter supplying section supplies, to the light source luminance control signal generating section during the suspension time period, the light source control parameter which has been calculated immediately before the suspension time period by the light source control parameter calculating section.

The display device of the present invention can be configured to further include a memory for storing therein each light source control parameter calculated by the light source control parameter calculating section in association with a corresponding frame, during the suspension time period, the light source control parameter supplying section (i) reading out, from the memory, a readout light source control parameter which is associated with a frame immediately before the suspension time period and then (ii) supplying, to the light source luminance control signal generating section, the readout light source control parameter.

The display device of the present invention can be configured such that the suspension controlling section supplies, to the light source control parameter supplying section, a suspension signal as an instruction signal for instructing the display controlling section to be suspended, and the light source control parameter supplying section reads out the readout light source control parameter at timing of receiving the suspension signal.

The display device of the present invention can be configured such that in a case where adjacent frames have respective different brightnesses, the light source control parameter calculating section calculates (i) at least one intermediate value between the brightnesses and (ii) light source control parameters, corresponding to the respective different brightnesses, based on the at least one intermediate value.

According to the configuration, in the case where the adjacent frames have the respective different brightnesses, the light source control parameter calculating section calculates (i) the at least one intermediate value between the brightnesses and (ii) the light source control parameters, corresponding to the respective different brightnesses, based on the at least one intermediate value. This makes a change in luminance smoother than a case where a light source control parameter corresponding to a first image is changed directly to a light source control parameter corresponding to a second image, the first and second images having respective different brightnesses.

Particularly, in a case where there is a great difference in luminance between a bright image and a dark image, such generation of a light source control parameter corresponding to the at least one intermediate value is effective.

The display device of the present invention can be configured such that in a case where adjacent frames have respective different brightnesses, the light source luminance control signal generating section (i) calculates at least one intermediate value between the brightnesses and (ii) outputs light source luminance control signals which are generated on the basis of the at least one intermediate value so as to correspond to the respective different brightnesses.

According to the configuration, in the case where the adjacent frames have respective different brightnesses, the light source luminance control signal generating section (i) calculates at least one intermediate value between the brightnesses and (ii) outputs light source luminance control signals which are generated on the basis of the at least one intermediate value so as to correspond to the respective different brightnesses. This makes a change in luminance smoother than a case where a light source control parameter corresponding to a first image is changed directly to a light source control parameter corresponding to a second image, the first and second images having respective different brightnesses.

Particularly, in a case where there is a great difference in luminance between a bright image and a dark image, such generation of a light source control parameter corresponding to the at least one intermediate value is effective.

It is preferable that the display panel is a liquid crystal display panel.

In a case where the display panel is the liquid crystal display panel, the above-described technique is effective. Response speed of liquid crystal, to which a voltage is applied, is low. Therefore, for example, in a case where a voltage is applied to the liquid crystal display panel so that a bright image is changed to a dark image, liquid crystal of the liquid crystal display panel gradually responds, so that the bright image is changed to the dark image.

In such a case where the bright image is gradually changed to the dark image, it is possible to display a high quality image, in which no flicker is caused due to a difference in luminance, by causing a luminance of a light source to be gradually changed.

The present invention is not limited to the description of the embodiments above, and can therefore be modified by a skilled person in the art within the scope of the claims. Namely, an embodiment derived from a proper combination of technical means disclosed in different embodiments is encompassed in the technical scope of the present invention.

INDUSTRIAL APPLICABILITY

The present invention is applicable to all devices each of which employs a backlight.

REFERENCE SIGNS LIST

100: display device
200: timing controlling section
210: timing generating block (suspension controlling section)
220: image processing block (display controlling section)
221: image analyzing section (display controlling section)
222: gray scale converting section (display controlling section)
223: gray scale characteristic determining section (display controlling section)
224: BL control parameter calculating section (light source control parameter calculating section)
225: output section (light source control parameter supplying section)
226: memory
227: dimming process section
230: BL luminance control signal generating block (light source luminance control signal generating section)
231: dimming process section
300: scan line driving circuit (display controlling section)
400: signal line driving circuit (display controlling section)
500: display panel
600: backlight unit (light source)
700: backlight unit controlling section (light source luminance controlling section)

The invention claimed is:

1. A display device, comprising:

a light source for irradiating a display panel with light;

a light source luminance controlling section for controlling a luminance of the light source in accordance with a light source luminance control signal for controlling the luminance of the light source;

a display controlling section for carrying out driving control with respect to the display panel;

a suspension controlling section for controlling the display controlling section to be suspended for a predetermined period of time on a predetermined cycle;

a light source control parameter calculating section for calculating a light source control parameter on the basis of gray scale information of an input image;

a light source luminance control signal generating section for generating the light source luminance control signal on the basis of the light source control parameter; and a light source control parameter supplying section for supplying the light source control parameter to the light source luminance control signal generating section, the light source control parameter supplying section supplying, to the light source luminance control signal generating section during a suspension time period during which the suspension controlling section controls the display controlling section to be suspended, a light source control parameter which has been calculated, immediately before the suspension time period, by the light source control parameter calculating section.

2. The display device as set forth in claim 1, wherein:

at timing of transition from a first image to a second image, the first and second images having respective different gray scales obtained from gray scale information of an input image, the light source control parameter supplying section supplies, to the light source luminance control signal generating section during the suspension time period, the light source control parameter which has been calculated immediately before the suspension time period by the light source control parameter calculating section.

3. A display device as set forth in claim 1 or 2, further comprising:

a memory for storing therein each light source control parameter calculated by the light source control parameter calculating section in association with a corresponding frame, during the suspension time period, the light source control parameter supplying section (i) reading out, from the memory, a readout light source control parameter which is associated with a frame immediately before the suspension time period and then (ii) supplying, to the light source luminance control signal generating section, the readout light source control parameter.

4. The display device as set forth in claim 3, wherein:

the suspension controlling section supplies, to the light source control parameter supplying section, a suspension signal as an instruction signal for instructing the display controlling section to be suspended, and the light source control parameter supplying section reads out the readout light source control parameter at timing of receiving the suspension signal.

5. The display device as set forth in claim 4, wherein:

in a case where adjacent frames have respective different brightnesses, the light source control parameter calculating section calculates (i) at least one intermediate value between the brightnesses and (ii) light source control parameters, corresponding to the respective different brightnesses, based on the at least one intermediate value.

6. The display device as set forth in claim 4, wherein:

in a case where adjacent frames have respective different brightnesses, the light source luminance control signal generating section (i) calculates at least one intermediate value between the brightnesses and (ii) outputs light source luminance control signals which are generated on the basis of the at least one intermediate value so as to correspond to the respective different brightnesses.

7. The display device as set forth in claim 1, wherein the display panel is a liquid crystal display panel.

8. A method of causing a display device to carry out display, the display device, comprising:

a light source for irradiating a display panel with light;

a light source luminance controlling section for controlling a luminance of the light source in accordance with a light source luminance control signal for controlling the luminance of the light source;

a display controlling section for carrying out driving control with respect to the display panel;

a suspension controlling section for controlling the display controlling section to be suspended for a predetermined period of time on a predetermined cycle;

a light source control parameter calculating section for calculating a light source control parameter on the basis of gray scale information of an input image;

a light source luminance control signal generating section for generating the light source luminance control signal on the basis of the light source control parameter; and a light source control parameter supplying section for supplying the light source control parameter to the light source luminance control signal generating section, said method comprising the step of:

causing the light source control parameter supplying section to supply, to the light source luminance control signal generating section during a suspension time period during which the suspension controlling section controls the display controlling section to be suspended, a light source control parameter which has been calculated, immediately before the suspension time period, by the light source control parameter calculating section.

* * * * *